US006210452B1

(12) United States Patent
Su

(10) Patent No.: US 6,210,452 B1
(45) Date of Patent: Apr. 3, 2001

(54) FUEL ADDITIVES

(75) Inventor: Wei-Yang Su, Austin, TX (US)

(73) Assignee: Hhntsman Petrochemical Corporation, Austin, TX (US)

( * ) Notice: Subject to any disclaimer, the term of this patent is extended or adjusted under 35 U.S.C. 154(b) by 0 days.

(21) Appl. No.: 09/500,175

(22) Filed: Feb. 8, 2000

(51) Int. Cl.[7] ..... C10L 1/18
(52) U.S. Cl. ..... 44/410
(58) Field of Search ..... 44/410, 443

(56) References Cited

U.S. PATENT DOCUMENTS

| | | | | |
|---|---|---|---|---|
| 2,807,525 | * | 9/1957 | Foreman | 44/443 |
| 2,807,526 | * | 9/1957 | Foreman | 44/443 |
| 3,753,670 | | 8/1973 | Strang et al. | 44/72 |
| 3,756,793 | | 9/1973 | Robinson | 44/62 |
| 4,398,921 | | 8/1983 | Rifkin et al. | 44/56 |
| 4,832,702 | | 5/1989 | Kummer et al. | 44/62 |
| 4,877,416 | | 10/1989 | Campbell | 44/62 |
| 5,112,364 | | 5/1992 | Rath et al. | 44/418 |
| 5,298,039 | * | 3/1994 | Mohr et al. | 44/412 |
| 5,514,190 | | 5/1996 | Cunningham et al. | 44/415 |
| 5,697,988 | | 12/1997 | Malfer et al. | 44/415 |
| 5,752,989 | * | 5/1998 | Henly et al. | 44/443 |
| 5,810,894 | | 9/1998 | Dever et al. | 44/412 |
| 5,873,917 | | 2/1999 | Daly | 44/443 |
| 5,912,189 | | 6/1999 | Wolak et al. | 44/329 |

FOREIGN PATENT DOCUMENTS

| | | | |
|---|---|---|---|
| 2089833 | 8/1993 | (CA) | C10L/1/18 |
| 0476485 | 3/1992 | (EP) | C08F/8/30 |
| 0516838 | 7/1996 | (EP) | C10L/1/22 |

OTHER PUBLICATIONS

Crema et al., "Effect of Thermal Stability of Detergents and Carrier Fluids on the Formation of Combustion Chamber Deposits," Proceedings of the International Spring Fuels & Lubricants Meeting (May 6–8, 1996) Paper No. 961097, pp. 1–22.

Lacey et al., "A Laboratory–Scale Test to Predict Intake Valve Deposits," Proceedings of the International Fall Fuels & Lubricants Meeting & Exposition (Oct. 13–16, 1997) Paper No. 972838, pp. 239–250.

* cited by examiner

*Primary Examiner*—Margaret Medley
*Assistant Examiner*—Cephia D. Toomer
(74) *Attorney, Agent, or Firm*—Nicole Peffer; Tim Headley; Gardere Wynne Sewell LLP

(57) ABSTRACT

Highly effective fuel additives that control the formation of deposits in internal combustion engines, particularly, in the fuel injection system and combustion chamber of such engines. The fuel additives comprise carboxylic acid alkoxylates, and are particular suited for use with nitrogen-containing fuel detergents. Fuel compositions comprising the fuel additives, and methods of controlling engine deposits are also disclosed.

21 Claims, No Drawings

FUEL ADDITIVES

TECHNICAL FIELD

This invention relates to novel fuel additives, and, more particularly, to fuel additives that prevent or reduce deposits in internal combustion engines.

BACKGROUND OF THE INVENTION

The performance of an internal combustion engine may be adversely affected by the formation of deposits in or around the fuel injection system and combustion chamber. Even when present in minor amounts, these deposits can cause a noticeable reduction in the performance of the engine, an increase in fuel consumption, and the production of exhaust pollutants. It is generally accepted that deposit formation is largely dependent on the fuel composition, and to a lesser extent, on the engine design and on the operating conditions of the engine. In an effort to control deposit formation, considerable efforts have been directed toward developing fuel compositions that have a reduced tendency to cause the formation of deposits. In particular, the majority of the research has been directed toward developing fuel additives that either prevent or reduce the formation of such deposits.

For example, U.S. Pat. No. 5,912,189 discloses compositions that are useful as fuel additives for reducing intake valve deposits. Such compositions comprise the reaction product of: (a) a cyclic compound containing at least one nitrogen and at least one carbonyl group; (b) an aldehyde or ketone; and (c) an etheramine.

U.S. Pat. No. 5,873,917 discloses compositions that are useful in reducing intake valve deposits. Such compositions contain: (a) a polyether alcohol; (b) a hydrocarbylphenol; and (c) optionally, a nitrogen-containing dispersant.

U.S. Pat. No. 5,514,190 discloses fuel additive compositions for controlling intake valve deposits. These compositions comprise: (a) a gasoline-soluble Mannich reaction product of a high molecular weight alkyl-substituted phenol, an amine, and an aldehyde; (b) a gasoline-soluble poly (oxyalkylene) carbamate; and (c) a gasoline-soluble poly (oxyalkylene) alcohol, glycol, or polyol, or mono or diether thereof.

U.S. Pat. No. 5,697,988 discloses a fuel additive composition that reduces engine deposits and controls octane requirement increases in engines. The fuel additive composition comprises: (a) a Mannich reaction product of a high molecular weight alkyl-substituted phenol, an amine, and an aldehyde; (b) a polyoxyalkylene compound; and (c) optionally, a poly- -olefin.

Despite such efforts, further improvements in the art are needed. Specifically, what are needed are fuel additives that function as fuel detergent promoters that prevent or reduce deposit formation in engines, fuel compositions containing such fuel additives, and a method for controlling the formation of deposits in engines.

SUMMARY OF THE INVENTION

Accordingly, the present invention includes novel fuel additives that control the formation of deposits in engines. The fuel additives are particularly suited for controlling the formation of deposits in fuel injection systems, and are thought to reduce deposit formation in combustion chambers. The fuel additives of the present invention comprise carboxylic acids that have been alkoxylated with one or more lower molecular weight alkylene oxides, and have the following general formula:

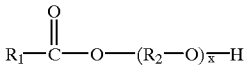

where $R_1$ is an aliphatic hydrocarbon with from about seven to about twenty-seven carbon atoms; each $R_2$ is independently a straight or branched chain alkylene group with from about two to about six carbon atoms; and x is a number from about three to about forty. The fuel additives of the present invention function as detergent promoters to improve the detergency of conventional nitrogen-containing fuel detergents.

The present invention also includes fuel compositions that contain the novel fuel additives of the present invention. The fuel compositions comprise a motor fuel, a minor amount of a nitrogen-containing fuel detergent, and a minor amount of an alkoxylated carboxylic acid fuel additive of the present invention. Such fuel compositions are particularly suited for controlling fuel injection system deposits in engines, and are expected to reduce combustion chamber deposits in such engines.

The present invention additionally provides for a method for controlling the formation of deposits in engines, and particularly, in the fuel injection system and combustion chamber of such engines. The method involves fueling and operating such engines with a fuel composition comprising a motor fuel, a nitrogen-containing fuel detergent, and an alkoxylated carboxylic acid fuel additive of the present invention.

DETAILED DESCRIPTION OF THE PREFERRED EMBODIMENT

The fuel additives of the present invention comprise alkoxylated carboxylic acids (carboxylic acid alkoxylates). These alkoxylates may be prepared according to any number of conventional methods known in the art. For example, the carboxylic acid alkoxylates may be prepared by reacting a carboxylic acid with one or more lower molecular weight alkylene oxides in the presence of a basic solution. Using this method, a typical preparation involves charging a carboxylic acid and a 45% aqueous potassium hydroxide solution to a reactor. The reactor should then be purged with nitrogen, and heated to a temperature of about 110° C. Using both vacuum and nitrogen stripping, the reaction products should be dried at this temperature until the water content is reduced to less than about 0.1 percent. Then, one or more lower molecular weight alkylene oxides should be added to the reactor, as the temperature of the reactor is maintained at about 105–113° C. Upon the conclusion of the reaction, the alkaline reaction product should then be neutralized. The alkaline reaction product may be neutralized with an aqueous slurry of Magnesol® 30/40 (commercially available from The Dallas Group of America, Whitehouse, New Jersey) adsorbent by heating the reaction components at a temperature of 110° C., with stirring, for approximately two hours. The neutralized mixture should then be vacuum stripped and filtered. Preferably, the resulting product should have a hydroxyl number from about 15 mg KOH/g to about 150 mg KOH/g.

Preferably, the carboxylic acid used to prepare the carboxylic acid alkoxylates of the present invention comprises a carboxylic acid with from about eight to about twenty-eight carbon atoms. More preferably, the carboxylic acid may include, but is not limited to, coconut fatty acid, tall oil fatty acid, tallow fatty acid, oleic acid, or soya fatty acid.

Preferably, the lower molecular weight alkylene oxide used to prepare the carboxylic acid alkoxylates of the present invention comprises ethylene oxide, propylene oxide, butylene oxide, or mixtures thereof.

Preferably, the alkoxylates of the present invention have the following general formula:

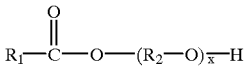

where $R_1$ is an aliphatic hydrocarbon with from about seven to about twenty-seven carbon atoms; each $R_2$ is independently a straight or branched chain alkylene group with from about two to about six carbon atoms; and x is a number from about three to about forty. More preferably, $R_1$ is an aliphatic hydrocarbon with from about nine to about twenty-three carbon atoms, and x is a number from about ten to about twenty.

The alkoxylates of the present invention are particularly suited for use with any number of conventional nitrogen-containing fuel detergents, or mixtures thereof, including, but not limited to polybutene amines, polybutene-based mannich amines, and mixtures thereof. Such nitrogen-containing fuel detergents are more particularly described in the following patents: British Pat. No. 1,083,610, British Pat. No. 1,094,020, European Pat. No. 0476 485B1, U.S. Pat. No. 3,753,670, U.S. Pat. No. 3,756,793, U.S. Pat. No. 3,948,619, U.S. Pat. No. 4,832,702, U.S. Pat. No. 5,112,364, and U.S. Pat. No. 5,810,894, which are incorporated by reference.

The alkoxylates of the present invention may be blended with fuel compositions to prevent or reduce the formation of deposits in engines powered by such fuel compositions. In particular, the alkoxylates of the present invention are capable of preventing or reducing the formation of deposits in the fuel injection system of engines powered by such fuel compositions. The alkoxylates of the present invention are also thought to reduce combustion chamber deposits in engines powered by such fuel compositions.

Preferably, the fuel compositions comprise a motor fuel, a minor amount of a nitrogen-containing detergent, and a minor amount of an alkoxylate of the present invention. The term "minor amount" means that the fuel composition contain less than about 5000 ppm of a nitrogen-containing detergent, and less than about 5000 ppm of an alkoxylate of the present invention, based on the total fuel composition weight. More preferably, the fuel composition comprises from about 20 ppm to about 2000 ppm of a nitrogen-containing detergent, and from about 20 ppm to about 2000 ppm of an alkoxylate of the present invention, based on the total fuel composition weight.

In the fuel composition, the motor fuel may comprise any number of conventional motor fuels, including, but not limited to, gasoline or diesel. Such motor fuels may also contain other components, such as alcohols, ethers, or mixture thereof. Such alcohols may include, but are not limited to, methanol, ethanol, or tert-butanol. Such ethers may include, but are not limited to, methyl tert-butyl ether. The motor fuels may be lead-containing or lead-free fuels. Preferably, the motor fuel comprises hydrocarbons in the gasoline boiling ranges.

The fuel compositions of the present invention may also contain other additives that are well known to those skilled in the art. Such additional additives may include, but are not limited to, anti-knocking agents such as tetra-alkyl lead compounds, lead scavengers such as haloalkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers such as polyoxyalkylene glycols or oxyalkylated phenolic resins, anti-icing agents, and mixtures thereof.

The alkoxylates of the present invention may be used to control deposits in engines, and in particular, deposits in and around the fuel injection system and combustion chamber of such engines. In order to control such deposits, the engine should be fueled and operated with a fuel composition that comprises a motor fuel, a minor amount of a nitrogen-containing fuel detergent, and a minor amount of an alkoxylate of the present invention.

The following examples are illustrative of the present invention, and are not intended to limit the scope of the invention in any way.

PREPARATION OF THE ALKOXYLATES

EXAMPLE 1a

Five pounds of Emery 622 coconut fatty acid (commercially available from the Henkel Corporation, Gulph Mills, Pennsylvania) and 106.4 grams of 45% aqueous potassium hydroxide solution were charged to a fifteen gallon reactor. The reactor was then purged with nitrogen, and heated to a temperature of about 110° C. Using both vacuum and nitrogen stripping, the reaction products were dried at this temperature until the water content was reduced to less than 0.1 percent. Then, 19.45 pounds of propylene oxide were added to the reactor, as the temperature of the reactor was maintained at about 105–113° C. Upon the conclusion of the reaction, the alkaline reaction product was then neutralized with 450 grams of an aqueous slurry of Magnesol® 30/40 adsorbent by heating the reaction components at a temperature of 110° C., with stirring, for approximately two hours. The neutralized mixture was then vacuum stripped and filtered. The resulting product had a hydroxyl number of 57.6 mg KOH/g.

EXAMPLE 1b

Five pounds of Emery 622 coconut fatty acid and 106.4 grams of 45% aqueous potassium hydroxide were charged to a fifteen gallon reactor. The reactor was then purged with nitrogen, and heated to a temperature of about 110° C. Using both vacuum and nitrogen stripping, the reaction products were dried at this temperature until the water content was reduced to less than 0.1 percent. Then, 11.8 pounds of propylene oxide and 9.6 pounds of 1,2-butylene oxide were added to the reactor, as the temperature of the reactor was maintained at about 105–113° C. Upon the conclusion of the reaction, the alkaline reaction product was then neutralized with 450 grams of an aqueous slurry of Magnesol® 30/40 adsorbent by heating the reaction components at a temperature of 110° C., with stirring, for approximately two hours. The neutralized mixture was then vacuum stripped and filtered. The resulting product had a hydroxyl number of 49.9 mg KOH/g.

TESTING OF THE ALKOXYLATES

EXAMPLE 2

The alkoxylates prepared in Examples 1a and 1b were then tested to determine their ability to control intake valve deposits. The effectiveness of the alkoxylates was measured using a test developed by the Southwest Research Institute, which is more particularly described in SAE Paper 972838, Tulsa, Okla., Oct. 13–16, 1997, which is incorporated by reference. The results of the testing are detailed in Table 1.

TABLE 1

| Detergent | Detergent (ppm) | Alkoxylate from Example 1a (ppm) | Alkoxylate from Example 1b (ppm) | Deposit (mg) |
|---|---|---|---|---|
| A[1] | 200 | 0 | 0 | 26.6 |
| | 200 | 200 | 0 | 7.0 |
| | 200 | 0 | 200 | 7.9 |
| B[2] | 200 | 0 | 0 | 56.3 |
| | 200 | 0 | 200 | 19.4 |
| C[3] | 130 | 0 | 0 | 11.9 |
| | 130 | 0 | 130 | 3.4 |
| D[4] | 300 | 0 | 0 | 102.0 |
| | 300 | 0 | 200 | 23.8 |

[1]Detergent A is a polybutylene amine (commercially available from the Ferro Corporation, Cleveland, Ohio).
[2]Detergent B is the reaction product of polyisobutylphenol (about 1000 molecular weight), formalin, and dimethylaminopropylamine.
[3]Detergent C is a polyisobutylamine produced via reductive amination of the corresponding polyisobutyl epoxide (about 1000 molecular weight).
[4]Detergent D is the reaction product of polyisobutylphenol (about 1000 molecular weight), formalin, and N-(2-hydroxyethyl)-N-methylaminopropylamine.

Tables 1 demonstrates that the alkoxylates of the present invention are higly effective at controlling intake valve deposits. The alkoxylates of the present invention, when combined with a nitrogen-containing fuel detergent, drastically improve the intake valve detergency of such nitrogen-containing fuel detergents.

Although illustrative embodiments have been shown and described, a wide range of modification, changes, and substitution is contemplated in the foregoing disclosure. In some instances, some features of the disclosed embodiments may be employed without a corresponding use of the other features. Accordingly, it is appropriate that the appended claims be construed broadly and in a manner consistent with the scope of the invention.

What is claimed is:

1. A method for controlling deposits in a gasoline engine comprising fueling and operating the engine with a fuel composition that comprises:

a. a motor fuel;

b. a minor amount of a nitrogen-containing fuel detergent; and c. a minor amount of a fuel additive that comprises a carboxylic acid alkoxylate with the following general formula:

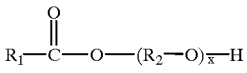

where $R_1$ is an aliphatic hydrocarbon with from about seven to about twenty-seven carbon atoms; each $R_2$ is independently a straight or branched chain alkylene group with from about two to about six carbon atoms; and x is a number from about three to about forty.

2. The method of claim 1, wherein the motor fuel comprises hydrocarbons in the gasoline boiling ranges.

3. The method of claim 1, wherein the motor fuel optionally comprises an alcohol, an ether, or mixtures thereof.

4. The method of claim 1, wherein the fuel composition comprises from about 20 ppm to about 2000 ppm of the nitrogen-containing detergent, based on the total fuel composition weight.

5. The method of claim 1, wherein the fuel composition comprises from about 20 ppm to about 2000 ppm of the fuel additive, based on the total fuel composition weight.

6. The method of claim 1, wherein $R_1$ is an aliphatic hydrocarbon with from about nine to about twenty-three carbon atoms, and x is a number from about ten to about twenty.

7. The method of claim 1, wherein $R_2$ is propylene.

8. The method of claim 1, wherein $R_2$ is butylene.

9. The method of claim 1, wherein $R_2$ is a mixture of propylene and butylene.

10. The method of claim 1, wherein the nitrogen-containing fuel detergent is selected from the group consisting of polybutene amines, polybutene-based mannich amines, and mixtures thereof.

11. A fuel composition that controls the formation of deposits in a gasoline engine that comprises:

a. a motor fuel;

b. a minor amount of a nitrogen-containing fuel detergent; and c. a minor amount of a fuel additive that comprises a carboxylic acid alkoxylate with the following general formula:

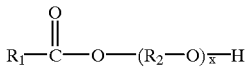

where $R_1$ is an aliphatic hydrocarbon with from about seven to about twenty-seven carbon atoms; each $R_2$ is independently a straight or branched chain alkylene group with from about two to about six carbon atoms; and x is a number from about three to about forty.

12. The fuel composition of claim 1, wherein the motor fuel comprises hydrocarbons in the gasoline boiling ranges.

13. The fuel composition of claim 1, wherein the motor fuel optionally comprises an alcohol, an ether, or mixtures thereof.

14. The fuel composition of claim 1, wherein the fuel composition comprises from about 20 ppm to about 2000 ppm of the nitrogen-containing detergent, based on the total fuel composition weight.

15. The fuel composition of claim 1, wherein the fuel composition comprises from about 20 ppm to about 2000 ppm of the fuel additive, based on the total fuel composition weight.

16. The fuel composition of claim 1, wherein $R_1$ is an aliphatic hydrocarbon with from about nine to about twenty-three carbon atoms, and x is a number from about ten to about twenty.

17. The fuel composition of claim 1, wherein $R_2$ is propylene.

18. The fuel composition of claim 1, wherein $R_2$ is butylene.

19. The fuel composition of claim 1, wherein $R_2$ is a mixture of propylene and butylene.

20. The fuel composition of claim 1, wherein the nitrogen-containing fuel detergent is selected from the group consisting of polybutene amines, polybutene-based mannich amines, and mixtures thereof.

21. The fuel composition of claim 11, wherein the fuel composition further comprises an additive selected from the group consisting of anti-knocking agents, lead scavengers, dyes, antioxidants, rust inhibitors, bacteriostatic agents, auxiliary dispersants and detergents, gum inhibitors, fluidizer oils, metal deactivators, demulsifiers, anti-icing agents, and mixtures thereof.

* * * * *

UNITED STATES PATENT AND TRADEMARK OFFICE

CERTIFICATE OF CORRECTION

PATENT NO. : 6,210,452 B1
DATED : April 3, 2001
INVENTOR(S) : Wei-Yang Su

It is certified that error appears in the above-identified patent and that said Letters Patent is hereby corrected as shown below:

Title page,
Item [73], Assignee, replace "Hhntsman" with -- Huntsman --

Column 1,
Line 52, replace "poly- -olefin" with -- poly-∝-olefin"

Column 3,
Line 48, replace "contain" with -- contains --

Column 5,
Line 27, replace "Tables" with -- Table --
Line 28, replace "higly" with -- highly --
Line 41, replace "a gasoline engine" with -- an engine --

Column 6,
Line 16, replace "a gasoline engine" with -- an engine --
Lines 34, 36, 39, 43, 46, 50, 52, 54 and 56, replace "claim 1" with -- claim 11 --

Signed and Sealed this

Third Day of September, 2002

*Attest:*

*Attesting Officer*

JAMES E. ROGAN
*Director of the United States Patent and Trademark Office*